US010136781B2

(12) United States Patent
Li et al.

(10) Patent No.: US 10,136,781 B2
(45) Date of Patent: Nov. 27, 2018

(54) FLOOR CLEANER, AND CLEANING MECHANISM FOR CLEARING CLEANING ROLLER

(71) Applicant: HiZero Technologies Co., Ltd., Shenzhen (CN)

(72) Inventors: Yang Li, Guangdong (CN); Yong Zhang, Shenzhen (CN)

(73) Assignee: HiZero Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/122,430

(22) PCT Filed: Oct. 10, 2015

(86) PCT No.: PCT/CN2015/091684
§ 371 (c)(1),
(2) Date: Aug. 30, 2016

(87) PCT Pub. No.: WO2017/059602
PCT Pub. Date: Apr. 13, 2017

(65) Prior Publication Data

US 2018/0206685 A1 Jul. 26, 2018

(51) Int. Cl.
*A47L 11/282* (2006.01)
*A47L 9/04* (2006.01)
*A47L 11/40* (2006.01)

(52) U.S. Cl.
CPC ..... *A47L 9/0477* (2013.01); *A47L 11/282* (2013.01); *A47L 11/4041* (2013.01); *A47L 11/4013* (2013.01)

(58) Field of Classification Search
CPC . A47L 9/0477; A47L 11/4041; A47L 11/4013
See application file for complete search history.

(56) References Cited

U.S. PATENT DOCUMENTS 2,881,461 A 4/1959 Parker
9,682,399 B2 6/2017 Utterback
(Continued)

FOREIGN PATENT DOCUMENTS

CN 2241510 Y 12/1996
CN 2794412 Y 7/2006
(Continued)

OTHER PUBLICATIONS

International Search Report/Written Opinion in international application No. PCT/CN2015/091684 dated Jul. 7, 2016, 7 pgs.
(Continued)

*Primary Examiner* — Shay Karls
(74) *Attorney, Agent, or Firm* — Cooper Legal Group, LLC

(57) ABSTRACT

A cleaning mechanism for clearing a cleaning roller of a cleaner. The cleaning mechanism includes: a cleaning roller for cleaning ground, a clearing component operating to clearing the cleaning roller, and a power unit. The clearing component includes a rotation body and a plurality of clearing elements disposed on the rotation body for clearing a surface of the cleaning roller. The power unit operates to drive the rotation body and the clearing elements to rotate along with the cleaning roller in the same direction. During the rotation of the cleaning roller, the trash is cleared by the clearing elements.

19 Claims, 12 Drawing Sheets

(56) References Cited

U.S. PATENT DOCUMENTS

| | | | | |
|---|---|---|---|---|
| 9,713,411 | B2 | 7/2017 | Gardner et al. | |
| 2001/0008036 | A1 * | 7/2001 | Worwag | A47L 9/02 15/387 |
| 2015/0082579 | A1 | 3/2015 | Lin | |

FOREIGN PATENT DOCUMENTS

| | | | | |
|---|---|---|---|---|
| CN | 203263303 | U | 11/2013 | |
| CN | 204105933 | U | 1/2015 | |
| EP | 1203556 | A2 | 5/2002 | |
| EP | 2801311 | A1 | 11/2014 | |
| JP | 2004147669 | A | 5/2004 | |
| JP | 2012228619 | A | 11/2012 | |
| WO | 2008095054 | A1 | 8/2008 | |
| WO | 2009018688 | A1 | 2/2009 | |
| WO | 2014137168 | A1 | 9/2014 | |
| WO | WO 2014137168 | A1 * | 9/2014 | A47L 11/201 |

OTHER PUBLICATIONS

International Search Report/Written Opinion in international application No. PCT/CN2015/091682 dated Jul. 7, 2016, 17 pgs.
International Search Report/Written Opinion in international application No. PCT/CN2015/091685 dated Jul. 20, 2016, 16 pgs.
Non-Final Office Action cited in U.S. Appl. No. 15/122,432 dated May 7, 2018, 7 pgs.
Notice of Allowance cited in U.S. Appl. No. 15/122,432 dated May 25, 2018, 11 pgs.
Japanese Office Action cited in Japanese Application No. 2017-563377 dated Jul. 3, 2018, 7 pgs.

* cited by examiner

FLOOR CLEANER, AND CLEANING MECHANISM FOR CLEARING CLEANING ROLLER

FIELD OF THE DISCLOSURE

The disclosure relates to cleaning equipment, and more particularly to a cleaning mechanism for clearing a cleaning roller of a cleaner.

BACKGROUND OF THE DISCLOSURE

Conventional cleaners for cleaning ground include brooms, mops and floor wipers, all of which are manual tools. With the development of science and technology, people pose high requirements for cleaners, and vacuum cleaner is developed, which operates to adsorb waste and dust on the ground through negative pressure produced by electric power. However, due to the limitation of the working principle, the vacuum cleaner fails to eliminate the waste and stains firmly attached to the ground. As a result, a new generation of cleaners for cleaning ground is provided. The new generation of cleaners includes a motor and a cleaning roller which is driven by the motor to clean the ground. The new generation of cleaners is equipped with a water supply system for washing the cleaning roller, thus capable of cleaning the ground completely.

To ensure the trash attached to the cleaning roller to be cleared and collected by the dust bin, a baffle plate is disposed beside the cleaning roller and above the dust bin. The trash on the cleaning roller is scraped by the baffle plate and falls into the dust bin. However, because the baffle plate is fixed on the dust bin, after long term of use, it tends to deform, thus greatly decreasing the clearing effect of the cleaner.

SUMMARY OF THE DISCLOSURE

In view of the above-described problems, it is one objective of the disclosure to provide a cleaning mechanism for clearing a cleaning roller and a floor cleaner.

The cleaning mechanism comprising:

a cleaning roller for cleaning ground, a clearing component operating to clearing the cleaning roller, and a power unit; wherein the clearing component comprises a rotation body and a plurality of clearing elements disposed on the rotation body for clearing a surface of the cleaning roller;

and the power unit operates to drive the rotation body and the clearing elements to rotate along with the cleaning roller in a same direction.

As an improvement of the disclosure, the clearing elements are strip-shaped, and one end of each strip-shaped clearing element is fixed on the rotation body, the other end thereof stretches to the cleaning roller.

As an improvement of the disclosure, the clearing elements are hair brush; at least one group of hair brush is provided, and each group of the hair brush is disposed along a center line of rotation of the rotation body.

As an improvement of the disclosure, each group of the hair brush is disposed along a center line of rotation of the rotation body in the shape of wave.

As an improvement of the disclosure, the clearing elements stretch to one end of the cleaning roller and contact an outer surface of the cleaning roller.

The disclosure also provides a floor cleaner, comprising a cleaning roller for cleaning ground, a clearing component operating to clearing the cleaning roller, and a power unit; wherein the clearing component comprises a rotation body and a plurality of clearing elements disposed on the rotation body for clearing surface of the cleaning roller;

and the power unit operates to drive the rotation body and the clearing elements to rotate along with the cleaning roller in a same direction.

As an improvement of the disclosure, the clearing elements are strip-shaped, and one end of each strip-shaped clearing element is fixed on the rotation body, the other end thereof stretches to the cleaning roller.

As an improvement of the disclosure, the clearing elements are hair brush; at least one group of hair brush is provided, and each group of the hair brush is disposed along a center line of rotation of the rotation body.

As an improvement of the disclosure, each group of the hair brush is disposed along a center line of rotation of the rotation body in the shape of wave.

As an improvement of the disclosure, the clearing elements stretch to one end of the cleaning roller and contact an outer surface of the cleaning roller.

Advantages of the cleaning mechanism for clearing a cleaning roller of a cleaner are summarized as follows.

The cleaning mechanism comprises: a cleaning roller for cleaning ground, a clearing component operating to clearing the cleaning roller, and a power unit. The clearing component comprises a rotation body and a plurality of clearing elements disposed on the rotation body for clearing a surface of the cleaning roller; and the power unit operates to drive the rotation body and the clearing elements to rotate along with the cleaning roller in a same direction to clear the trash on the cleaning roller. In this disclosure, the clearing elements are disposed on the rotation body, compared to conventional baffle plates, the connection mode is stable and reliable, so that even after a long term of use, the clearing effect of the cleaner still maintains good.

DETAILED DESCRIPTION OF THE EMBODIMENTS

Example 1

Figure 1:
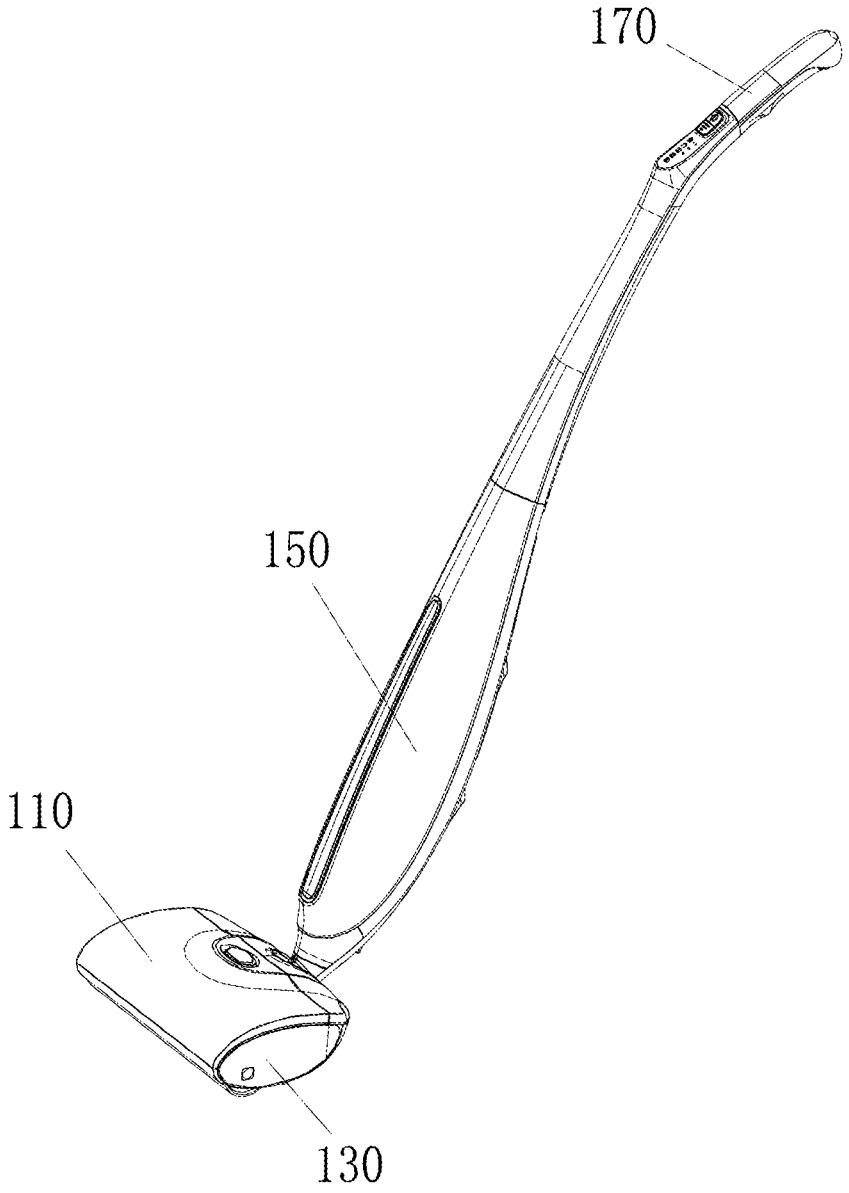
FIG. 1 is a schematic diagram of a floor cleaner of the disclosure.

To better clear conventional cleaning roller, a novel cleaning mechanism for clearing a cleaning roller of a cleaner is provided.

The cleaning mechanism comprises: a cleaning roller for cleaning ground, a clearing component operating to clearing the cleaning roller, and a power unit The clearing component comprises a rotation body and a plurality of clearing elements disposed on the rotation body for clearing a surface of the cleaning roller. The rotation body is a hollow tube or a solid shaft. The clearing component is fixed on the rotation body and protrudes therefrom. The power unit operates to drive the rotation body and the clearing elements to rotate along with the cleaning roller in a same direction.

Preferably, the clearing elements are strip-shaped, and one end of each strip-shaped clearing element is fixed on the rotation body, the other end thereof stretches to the cleaning roller.

One end of each clearing element stretching to the cleaning roller contacts the surface of the cleaning roller. The direct contact facilitates the clearing of the trash on the surface of the clearing elements. Optionally, there is a gap between the end of each clearing element stretching to the cleaning roller and the surface of the cleaning roller, and the gap is smaller than the volume of the trash, so that no trash can be leaked from the gap.

Preferably, the clearing elements are hair brush; at least one group of hair brush is provided, and each group of the hair brush is disposed along a center line of rotation of the rotation body. During the rotation of the cleaning roller, the trash is cleared. The hair brush is particularly suitable for clearing long and thin materials such as hair.

The clearing elements can be aligned, or other shapes. For example, each group of the hair brush is disposed along a center line of rotation of the rotation body in the shape of wave. Compared to conventional alignment, the wave-shaped arrangement can reduce the resistance of the clearing elements against the sponge roller, thus saving the energy consumption.

In this disclosure, the clearing elements are disposed on the rotation body, compared to conventional baffle plates, the connection mode is stable and reliable, so that even after a long term of use, the clearing effect of the cleaner still maintains good.

Example 2

The disclosure provides a cleaner for cleaning the ground.

The cleaner for cleaning the ground comprises a shell assembly, a cleaning mechanism, a water supply system, a control unit, and a connection mechanism.

The shell assembly is a support of the cleaner, and comprises two parts, one is a base, the other is a handle. The base and the handle is connected by the connection mechanism. The connection mode is flexible, so that the user can conveniently operate the cleaner with different angles.

The cleaning mechanism is a key part to clean the ground and is disposed on the base. The water supply system comprises a clean water tank and a wastewater tank. The clean water tank is configured to store clean water and communicates with the cleaning mechanism. Clean water is transported to the cleaning mechanism through a power unit to clean the cleaning mechanism. The wastewater tank is configured to store wastewater which is discharged from the cleaning mechanism communicating with the wastewater tank. The wastewater produced by the cleaning mechanism is restored in the wastewater tank via another power unit, thus preventing the wastewater from leaking out of the cleaner.

The control unit comprises a control circuit and a circuit board loading the control circuit. The control unit controls the operation of the cleaner, such as the operation and halt of the cleaning mechanism, the opening and closing of the water supply system, so as to achieve the man-machine interaction.

For better understanding the disclosure, the example defines where the base is located is the front part of the cleaner and the handle is the rear part of the cleaner.

Figure 2:
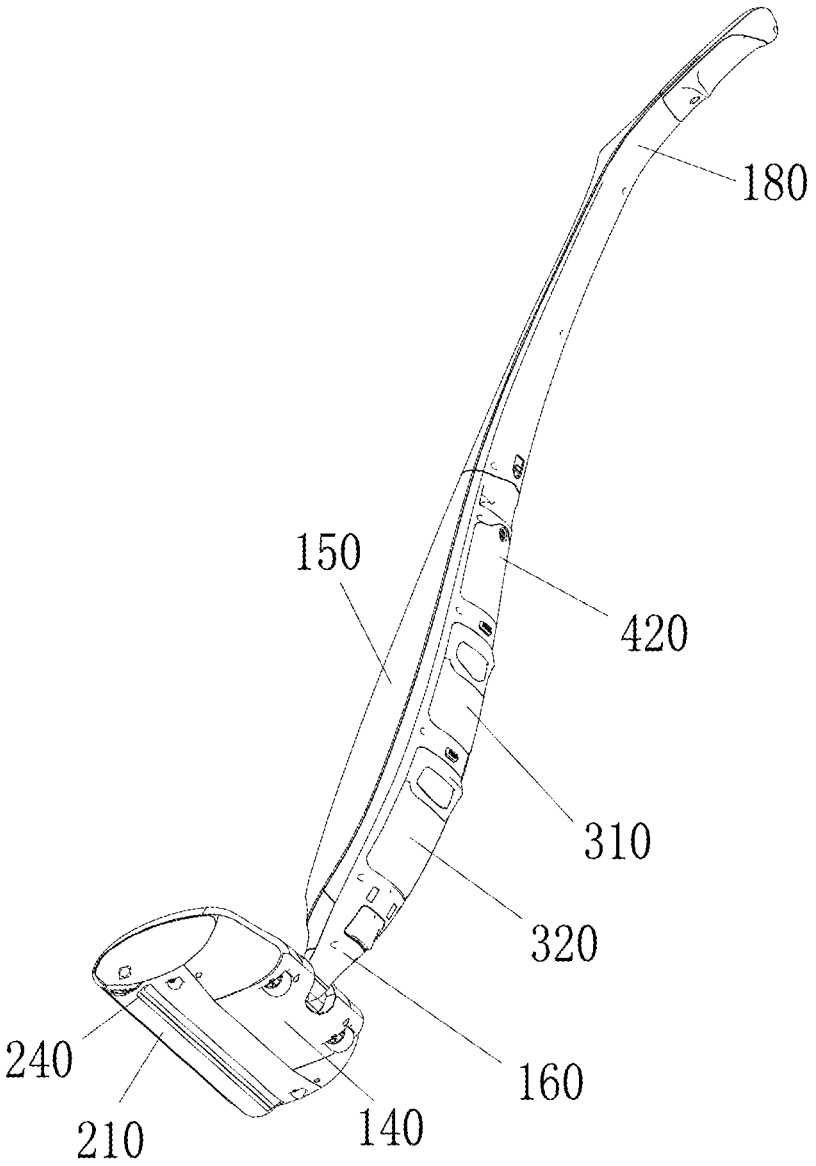
FIG. 2 is a schematic diagram of a floor cleaner in FIG. 1 from another angle of view.
Figure 3:
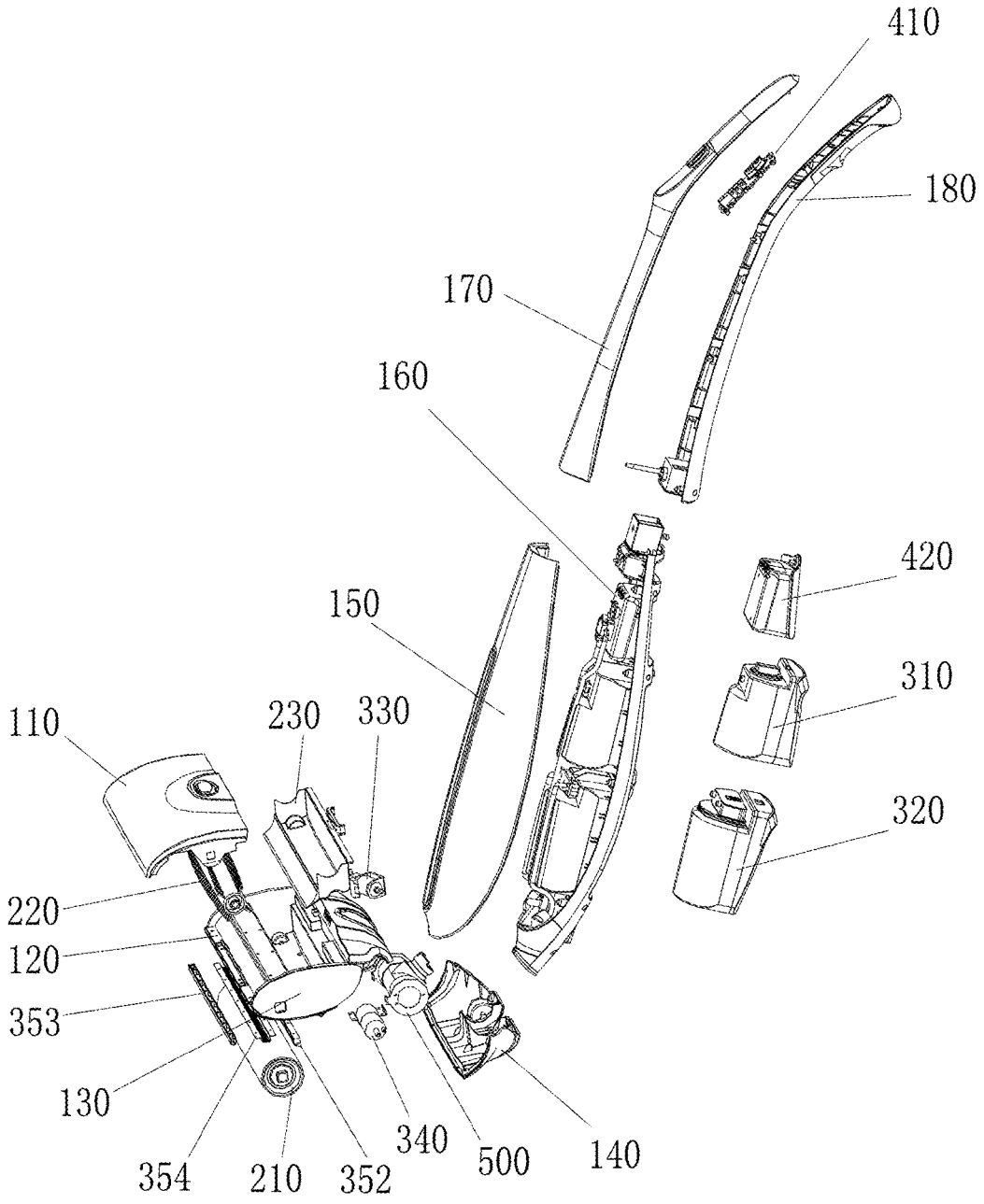
FIG. 3 is an exploded view of a floor cleaner in FIG. 1.

Specifically, as shown in FIGS. 1-3, the base comprises a turnable cover 110, a base shell 120, side shells 130, and a rear shell 140. The turnable cover 110 is disposed above the base shell 120 and may be flipped to open with respect to the base shell 120. The rear shell 140 is disposed at the lower rear of the base shell 120, and the side shells 130 are clamped at two sides of the base shell 120.

Also, as shown in FIGS. 1-3, the handle comprises a handle portion and a body portion. The handle portion comprises a top handle part 170 and a rear handle part 180. The body portion comprises a top body part 150 and a rear body part 160. The handle portion is mounted on the body portion. The body portion is connected to base through the adapter component 500 to realize the connection between the handle and the base.

As shown in FIGS. 3-6, the cleaning mechanism comprises a cleaning roller assembly 210, a clearing component 220 operating to remove trash on the cleaning roller assembly, and a dust bin 230 for collecting the trash on the cleaning roller assembly.

The cleaning roller assembly 210 comprises a cleaning roller. The cleaning roller rollers on the ground to clear the trash. Optionally, the cleaning roller is made of flexible material, for example, in this example, the cleaning roller is a sponge roller 211.

The cleaning roller assembly 210 further comprises a sleeve barrel 213 loading the sponge roller 211, and a power unit 212 for driving the sponge roller 211 and the sleeve barrel 213.

The power unit 212 is disposed on the side wall of the base shell 120 and is locked using a bolt. The side wall is vertical to the ground. The sleeve barrel 213 of the sponge roller 211 is sleeved on the power unit 212 and is replaceable. The sponge roller 211 is sleeved on the sleeve barrel 213, and the power unit 212 is disposed in the sleeve barrel 213. The power unit 212 is optionally a motor, and the opening and closing of the power unit 212 is controlled by the control unit.

Figure 4:
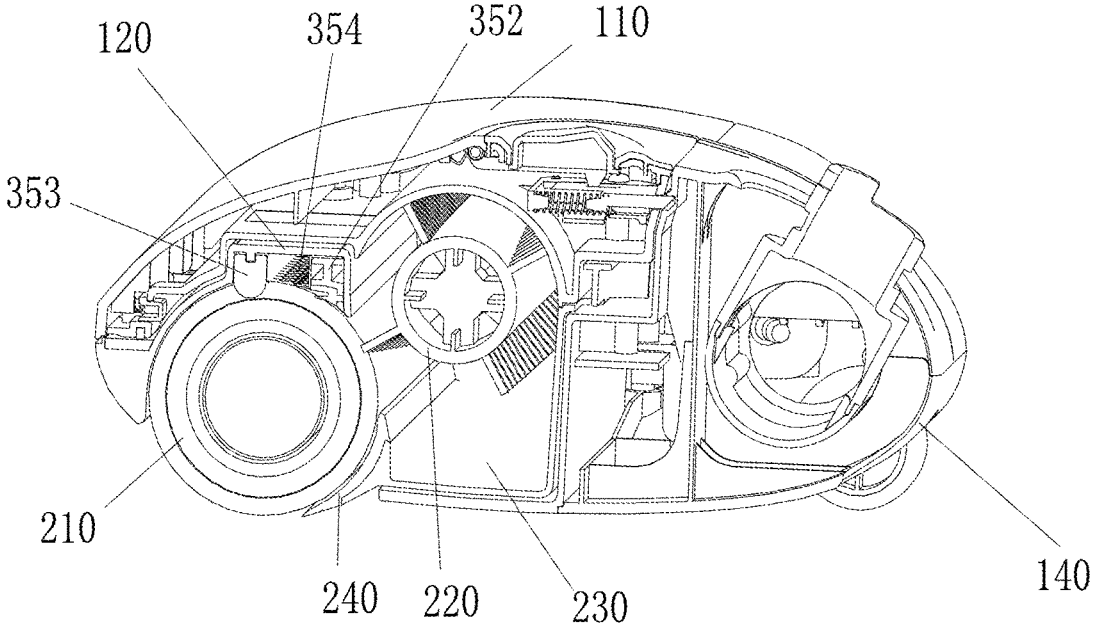
FIG. 4 is a sectional view of a base of a floor cleaner of the disclosure.
Figure 5:
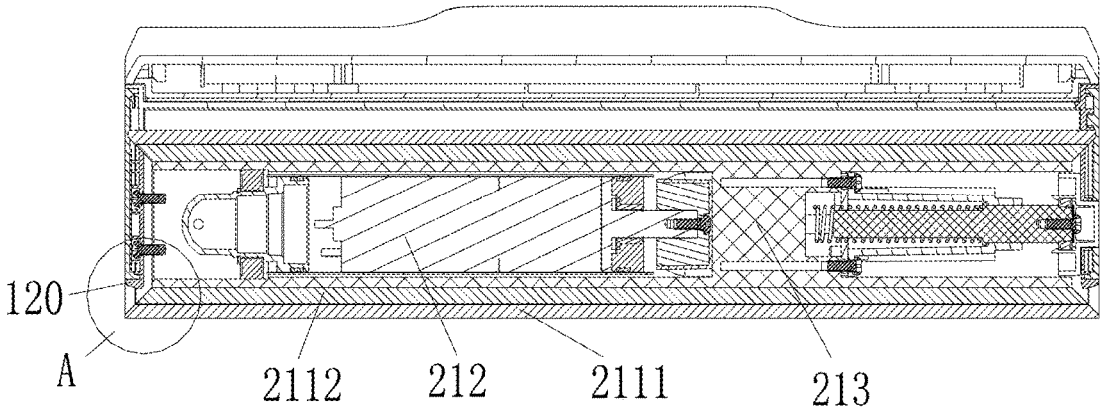
FIG. 5 is a sectional view of a cleaning roller assembly of a floor cleaner of the disclosure.
Figure 6:
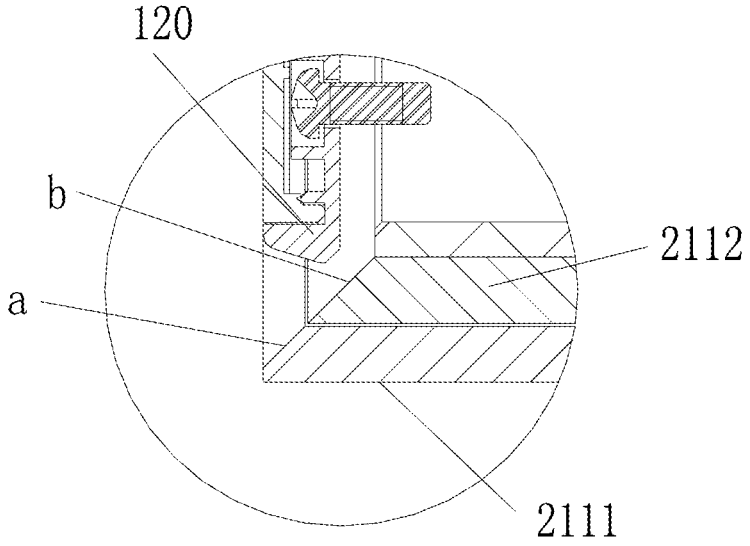
FIG. 6 is an enlarged view of part A in FIG. 5.

As shown in FIG. 4, the dust bin 230 is disposed at the lower rear of the sponge roller 211. Without affecting the rotation of the sponge roller 211, the dust bin can be close to the sponge roller 211 as possibly, so as to prevent the trash from leaking from the gap between the sponge roller 211 and the trash bin 230.

Figure 7:
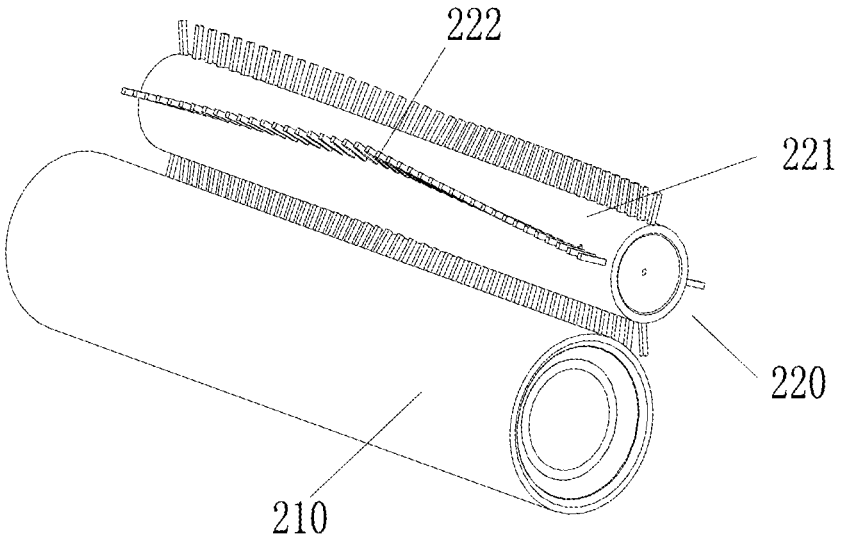
FIG. 7 is a schematic diagram showing the cooperation of a cleaning roller and a clearing component of a cleaner of the disclosure.

As shown in FIG. 7, the clearing component comprises a rotation body 221 and a plurality of clearing elements 222 disposed on the rotation body 221. The rotation body 221 is driven by a power unit (the power unit can be a motor, which is not shown in the drawings) to rotate along with the sponge roller 211 (clockwise or anticlockwise). The clearing elements 222 are strip-shaped, such as hair brush or tooth structures, and rotate with the rotation body 221. The gap between the clearing elements 222 and the sponge roller 211 is smaller than the volume of the trash or the clearing elements 222 and the sponge roller 211 directly contact with each other, so as to clear the trash on the sponge roller 211.

The clearing component 220 is disposed at the upper rear of the sponge roller 211, i.e., above the trash bin 230, so that the trash cleared from the sponge roller 211 falls into the trash bin 230.

To more efficiently clear the trash on the sponge roller 211, as shown in FIG. 7, the clearing elements 222 can be divided into at least two groups, each group comprises a plurality of clearing elements 222 which are disposed along the center line of rotation of the rotation body 221. The length of the clearing elements can be smaller than, larger than, or equal to the length of the sponge roller 211 along the center line of rotation of the rotation body 221.

As shown in FIG. 7, the clearing elements 222 can be aligned, or be disposed in the shape of wave. The latter can reduce the resistance of the clearing elements 222 against the sponge roller 211, thus saving the energy consumption.

Figure 8:
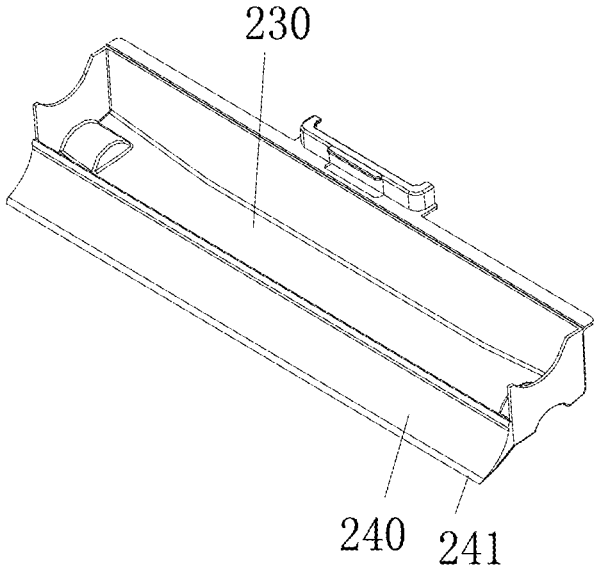
FIG. 8 is a schematic diagram of a dust bin of a cleaner of the disclosure.
Figure 10:
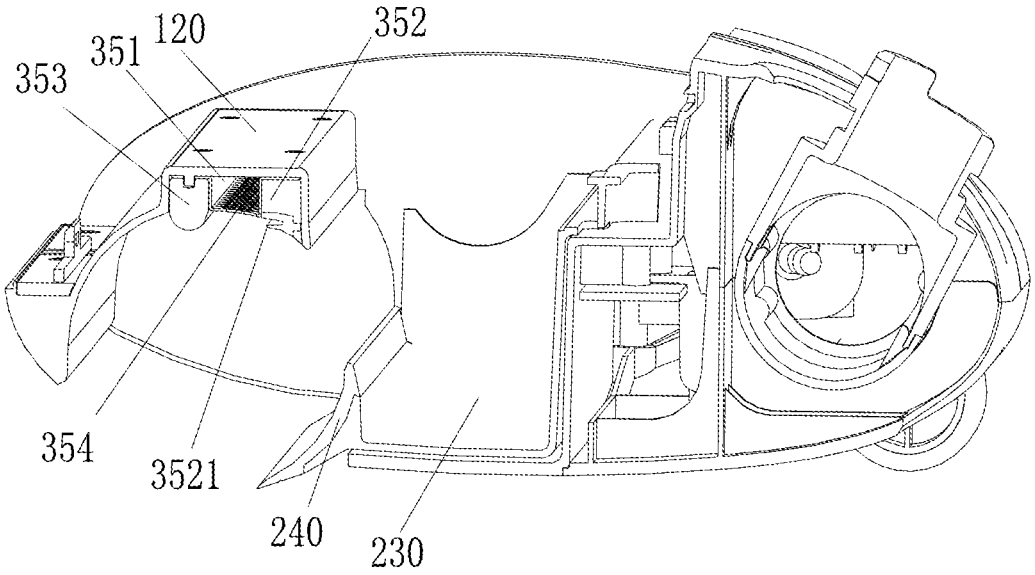
FIG. 10 is a schematic diagram of a water channel (not comprising a cleaning roller assembly) of a cleaner of the disclosure.

Furthermore, as shown in FIGS. 4 and 8, to improve the cleaning effect, in the cleaning mechanism, a scraper 240 is disposed at the rear of the sponge roller 211. The scraper 240 comprises a flexible front end 241 made of, for example, rubber. The front end 241 is attached to the ground, thus preventing the trash from omitting from the lower part of the cleaner. As shown in FIGS. 4 and 10, a gap exists between the scraper 240 and the sponge roller 211. The outer wall of the scraper 240 facing the sponge roller 211 is designed as an arc, and thus the gap operates as a guide channel to collect the trash.

As shown in FIGS. 3, 4, 9 and 11, the water supply system comprises a washing chamber, a clean water tank 310, a clean water supply device (for example, water pump 330), a wastewater tank 320, and a wastewater recovery device (for example, air pump 340).

The washing chamber is disposed on the rotation path of the sponge roller 211 and coordinates with the sponge roller 211 in a sealing mode. The washing chamber is filled with water to wash the sponge roller 211.

Figure 9:
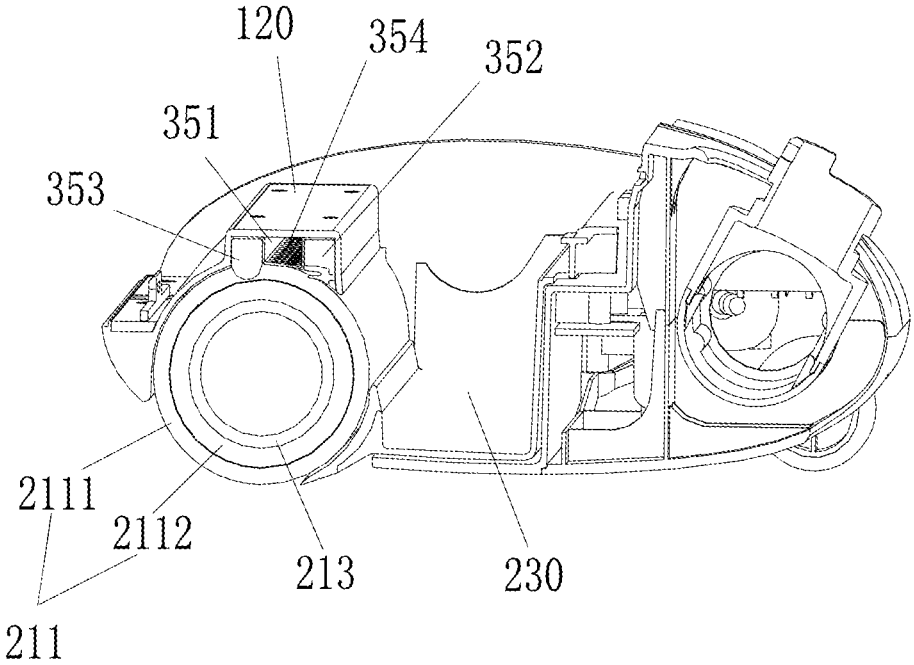
FIG. 9 is a schematic diagram of a water channel (comprising a cleaning roller assembly) of a cleaner of the disclosure.

As shown in FIGS. 9 and 10, the washing chamber is a water channel, or other chambers having a different structure. Part of the base shell 120 (can be regarded as the shell of the water channel) is concave to form the water channel 351, which simplifies the structure of the cleaner. Optionally, the water channel 351 can be an individual structure.

The water channel 351 is pressed on the sponge roller 211 in an overturn mode. The contact regions of the water channel 351 and the sponge roller 211 are sealed. Specifically, a seal element 352 and a water-squeezing member 353 are locked at two sides of the water channel 351 via bolts, respectively. The seal element 352 is behind the water-squeezing member 353, that is to say, the sponge roller 211 first moves to the seal element 352, and then to the water-squeezing member 353. The water-squeezing member 353 and the seal element 352 function as leak proof structures of the water channel 351 and the sponge roller 211, respectively. Additionally, the water-squeezing member 353 operates to squeeze out the water in the sponge roller 211. The wastewater squeezed out from the sponge roller 211 directly flows to the water channel 351, and then collected by the wastewater tank 320.

Figure 11:
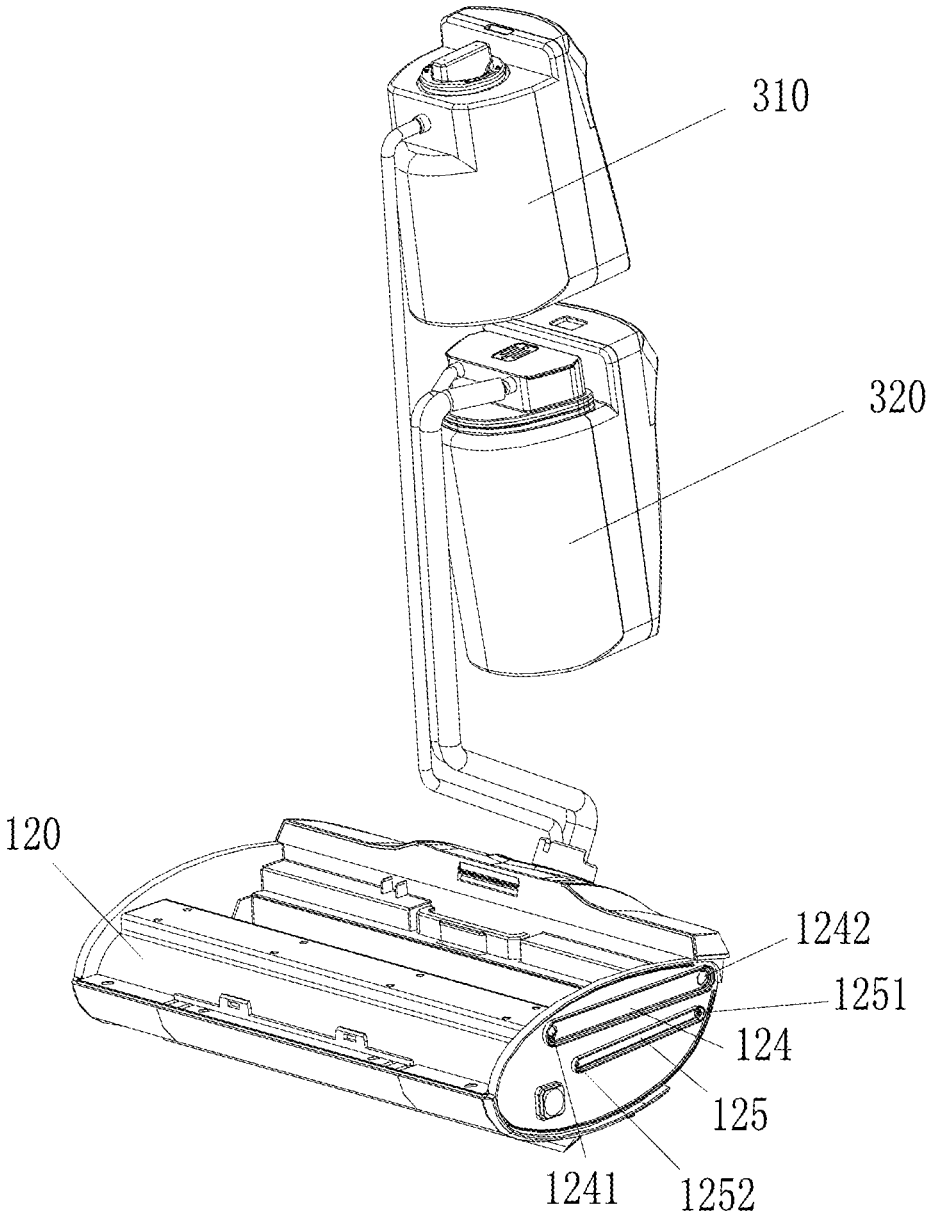
FIG. 11 is a schematic diagram of a water supply system of a cleaner of the disclosure.
Figure 12:
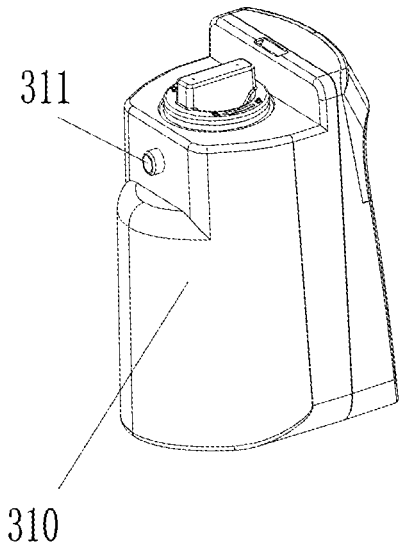
FIG. 12 is a schematic diagram of a clean water tank of a cleaner of the disclosure.
Figure 13:
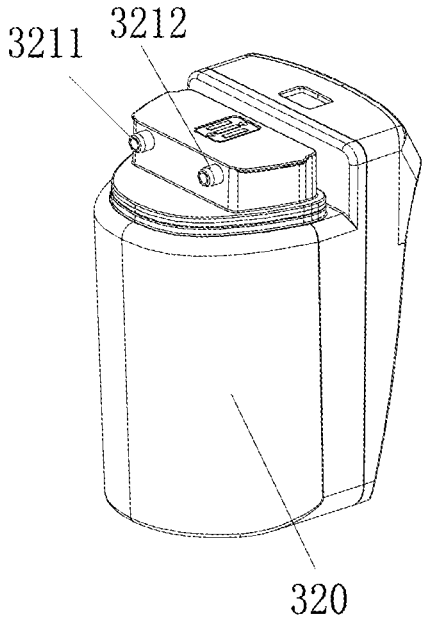
FIG. 13 is a schematic diagram of a wastewater tank of a cleaner of the disclosure.
Figure 14:
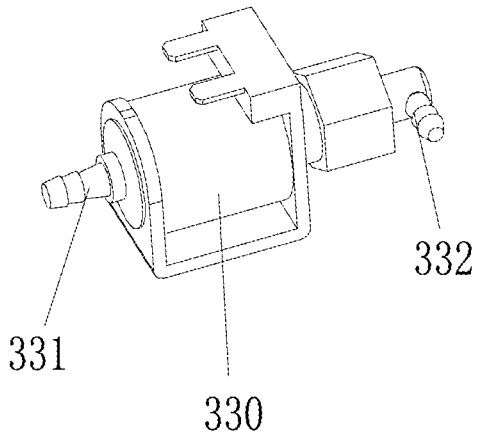
FIG. 14 is a schematic diagram of a water pump of a cleaner of the disclosure.
Figure 15:
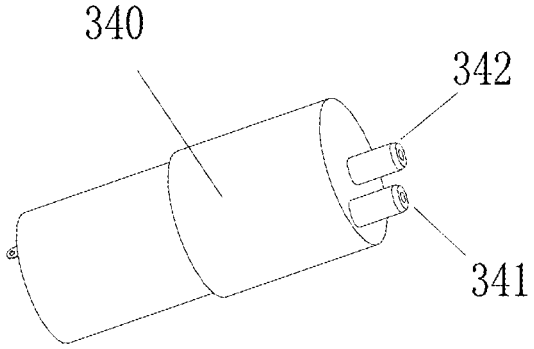
FIG. 15 is a schematic diagram of an air pump of a cleaner of the disclosure.

To improve the water squeezing effect, the water-squeezing member 353 is made of hard material, and the outer wall thereof contacting the sponge roller 211 is arc-shaped. For example, the water-squeezing member 353 are strips or shaft-shaped structures made of rigid plastic or metal. The seal element 352 only has the sealing properties. As shown in FIG. 11, the contact part 3521 of the seal element 352 and sponge roller 211 is a bulge made of elastic material, the elasticity thereof can prevent the trash on the sponge roller 211 from being squeezed out of the water channel 351.

To prevent large solid waste on the sponge roller 211 from entering the water supply system to block the waterway, as shown in FIGS. 9 and 10, a filter 354 is disposed in the water channel 351. Two ends of the filter 354 are pressed in the water channel 351 by the water-squeezing member 353 and the seal element 352.

As shown in FIGS. 3, 11, 12 and 14, the clean water outlet 311 of the clean water tank 310, the clean water inlet (not shown in the drawings) of the water channel 351 communicate with the water pump 330. The water inlet 331 of the water pump 330 communicates with the clean water outlet 311, the water outlet 332 thereof communicates with the clean water inlet 331. Driven by the water pump 330, clean water enters the water channel 351 via the clean water inlet to wash the sponge roller 211, and then flows out from the wastewater outlet 1241 of the water channel 351.

As shown in FIGS. 3, 11, 13 and 15, the wastewater outlet 1241, the wastewater inlet 3211 of the wastewater tank 320 communicate with the air pump 340. Specifically, the air pump 340 communicates with the air extraction opening 3212 of the wastewater tank 320, and the wastewater outlet 1241 of the water channel 351 communicates with the wastewater inlet 3211 of the wastewater tank 320. The air pump 340 operates to extract the air in the wastewater tank 320 to produce a negative environment, which is favorable to the wastewater tank 320 to absorb wastewater from the water channel 351. Employing the air pump 340 to absorb wastewater can flexibly control the wastewater tank 320 to absorb wastewater as needed.

Optionally, the clean water supply device is not limited to the water pump 330, it can also be an air pump instead of the water pump 330. The air pump communicates with the water channel 351. Through pumping, the pressure in the water channel 351 is decreased, the water channel sucks up clean water from the clean water tank 310. The working principle of the air pump is the same as the principle of the wastewater tank 320 for wastewater recovery.

Likewise, the wastewater recovery device is not limited to the air pump 340, it can also be a water pump instead of the air pump 340. The working principle of the water pump is the same as the principle of the clean water tank 310 for clean water supply.

As shown in FIGS. 3, 11, 13 and 15, because the air inlet 341 of the air pump 340 communicates with the wastewater tank 320, when the air pump 340 is working and the wastewater tank 320 waggles, the produced foams tend to be sucked up by the air pump 340.

To solve the problem, the wastewater tank 320 is modified. The wastewater tank 320 comprises a wastewater storage chamber and at least one splash-proof member. The splash-proof member separates the air extraction opening 3212 of the wastewater tank 320 from the storage chamber. The splash-proof member comprises an air vent communicating with the storage chamber. The air extraction opening 3212 of the wastewater tank 320 communicates with the air vent of the splash-proof member. Most of splashed foams are blocked by the splash-proof member, but the work of the air pump 340 is not affected. The more the splash-proof member, the better the splash-proof effect.

Figure 16:
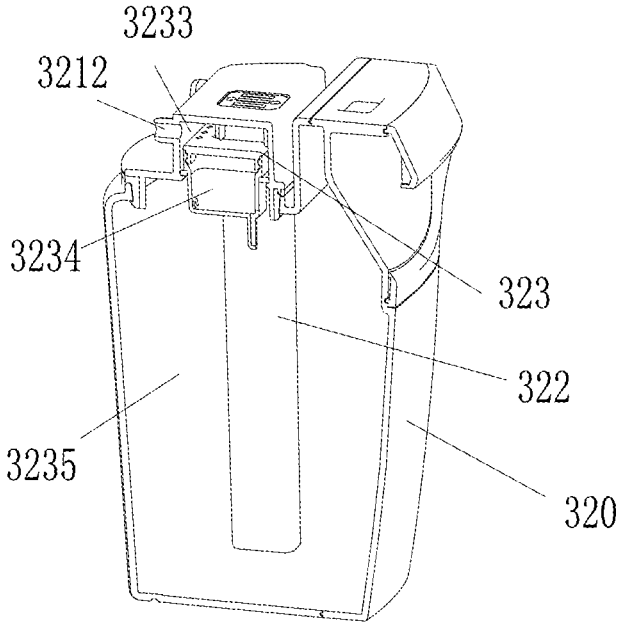
FIG. 16 is a sectional view of a wastewater tank of a cleaner of the disclosure.
Figure 17:
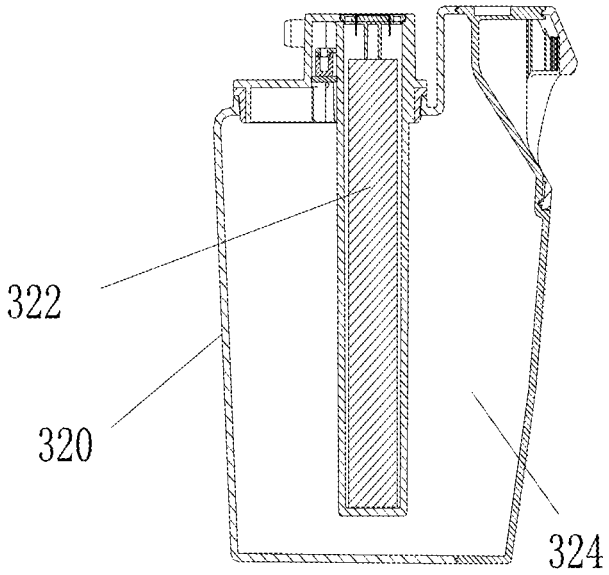
FIG. 17 is a sectional view of a wastewater tank of a cleaner of the disclosure from another angle of view.
Figure 18:
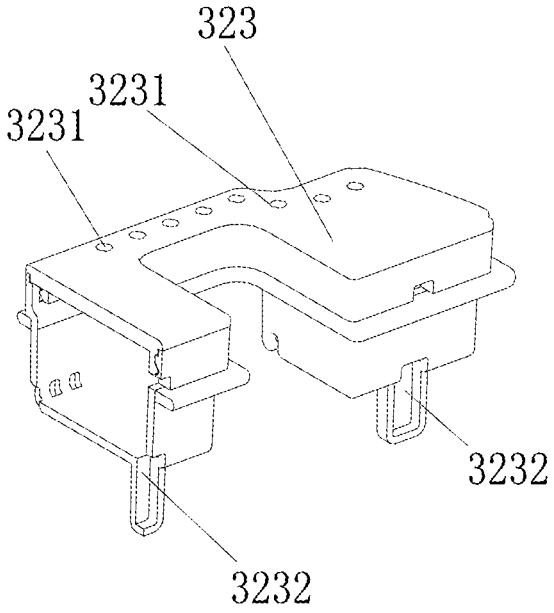
FIG. 18 is a sectional view of a splash-proof member of a cleaner of the disclosure.

Specifically, as shown in FIGS. 16, 17 and 18, the wastewater tank 320 comprises a chamber having the wastewater inlet 3211 and the air extraction opening 3212, a liquid level detector 322 and the splash-proof member 323. The liquid level detector 322 and the splash-proof member 323 both are disposed in the chamber. The liquid level detector 322 operates to detect the liquid level of the wastewater in the wastewater tank 320 and is connected to the control unit. When the wastewater overtakes the maximum, a switch is triggered to send signal to the control unit.

The splash-proof member 323 comprises a first buffer chamber 3234 comprising first air vents 3231 at the top thereof and second air vents 3232 at the bottom thereof. The first air vents 3231 and the second air vents 3232 are disposed at different directions. Specifically, the first air vents 3231 are disposed vertically, and the second air vents 3232 are disposed transversely. The staggered arrangement of the air vents can prevent the water entering from the second air vents 3232 from entering the first air vents 3231.

As shown in FIG. 17, when the splash-proof member 323 is disposed in the chamber, the chamber of the wastewater tank 320 is divided into a second buffer chamber 3233 and an accommodation chamber 3235. The second buffer chamber 3233 and the first buffer chamber 3234 communicate with each other via the first air vents 3231. The air extraction opening 3212 communicates with the second buffer chamber 3233. Therefore, through multiple levels of anti-splash, almost no water is pumped into the air pump 340.

To prevent the foams splashed in the wastewater tank 320 from entering the air pump 340, other options can also be adopted. For example, the air outlet 342 of the air pump 340 communicates with the sponge roller 211 or the water channel 351, and the water absorbed by the air pump 340 is discharged and collected by the sponge roller 211 or the water channel 351.

The waterways of the water channel 351, the clean water tank 310, the water pump 330, the wastewater tank 320, and the air pump 340 can be independent pipes, or be integrated with other structures for simplifying the cleaner. As shown in FIGS. 3 and 10, two sides of the base shell 120 are provided with a clean water channel, a wastewater channel 124, and a water-discharging channel 125. One end of the wastewater channel 124 is the wastewater outlet 1241 of the water channel 351, and the other end thereof is a wastewater adaptor 1242 connected to the wastewater tank 320. One end of the water-discharging channel 125 is a water inlet 1251, and the other end thereof is a water outlet 1252 communicating with the water channel 351 or the sponge roller 211. The clean water channel is disposed at the base shell 120 and opposite to the wastewater channel 124, and comprises an adaptor communicating with the water pump 330 and the clean water inlet of the water channel 351. The structure of the clean water channel is basically the same as that of the wastewater channel 124, so no more detailed description should be provided for the clean water channel. When the side shells 130 at two sides of the base shell 120 are locked on the base shell 120, the clean water channel, the wastewater channel 124, and the water-discharging channel 125 constitute a sealed waterway, thus forming a complete waterway.

To further improve the cleaning effect, the sponge roller 211 can be made much thicker. As a result, when washing the sponge, much more force must be exerted by the water-squeezing member 353 on the sponge roller 211 so as to squeeze water out of the sponge. However, when the squeezing force is much large, the rotation of the sponge roller 211 may be impeded, and to maintain the normal rotation of the sponge roller 211, much more energy must be imposed, thus causing more energy consumption.

Figure 19:
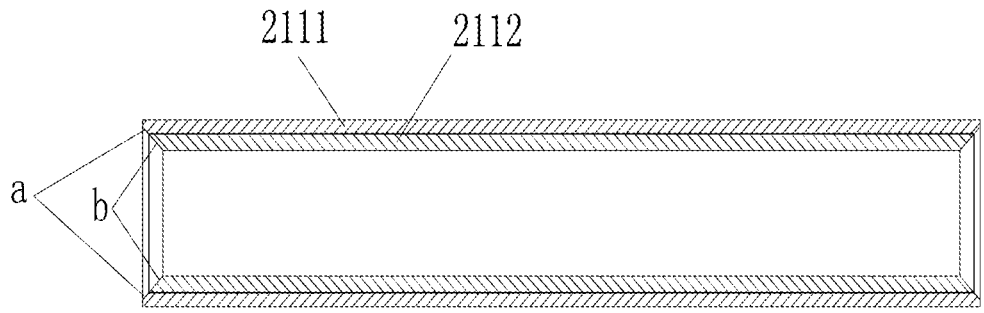
FIG. 19 is a sectional view of a sponge roller of a cleaner of the disclosure.
Figure 20:
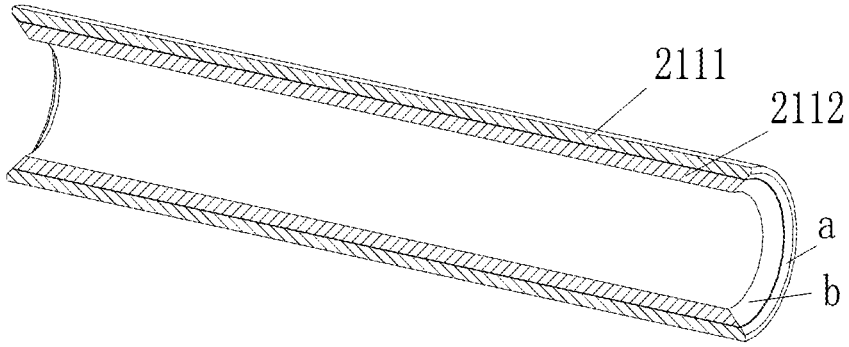
FIG. 20 is a sectional view of a sponge roller of a cleaner of the disclosure from another angle of view.

As shown in FIGS. 19 and 20, the sponge roller 211 comprises at least two layers, that is, an outer layer and an inner layer. The outer layer is an absorbent spongy layer 2111 and the inner layer is non-absorbent spongy layer 2112. The non-absorbent spongy layer 2112 is made of non-absorbent sponge and is incapable of absorbing water. The absorbent spongy layer 2111 is made of absorbent sponge, and water is mainly absorbed by the outer absorbent spongy layer 2111. Thus, to squeeze out water, only need to squeeze out water in the outer absorbent spongy layer 2111. Because the outer absorbent spongy layer is thinner than conventional spongy layer, the external force used for squeezing out water is gentle and does not impede the rotation of the sponge roller 211.

Conventionally, the sponge roller 211 is disposed in the base shell 120. Two ends of conventional cylindrical sponge roller are a circular surface vertical to the ground. The left and right side walls of the base shell 120 have a certain thickness, so that the sponge roller 120 cannot stretch into the region below the left and right side walls of the base shell 120 adjacent to the sponge roller 211 due to the circular structure of the sponge roller. As a result, the regions below the left and right side walls of the base shell 120 adjacent to the sponge roller 211 cannot be cleaned.

As shown in FIGS. 5, 6, 19 and 20, two ends of the sponge roller 211 are conical surfaces a and b. The conical surfaces a and b can stretch into the lower part of the left and right side walls of the base shell 120 adjacent to the sponge roller 211, thus cleaning the ground completely.

The control unit comprises a circuit board loading a control circuit and a man-machine interaction unit. Because the control unit is not the key point of improvement of the disclosure, no detailed description is provided herein. FIG. 3 shows keys of the man-machine interaction unit.

While particular embodiments of the disclosure have been shown and described, it will be obvious to those skilled in the art that changes and modifications may be made without departing from the disclosure in its broader aspects, and therefore, the aim in the appended claims is to cover all such changes and modifications as fall within the true spirit and scope of the disclosure.

The invention claimed is:

1. A cleaning mechanism for clearing a cleaning roller of a cleaner, the cleaning mechanism comprising:

a cleaning roller for cleaning ground;

a clearing component operating to clear the cleaning roller;

a scraper having an arc-shaped surface facing the cleaning roller, wherein the scraper defines an opening in which the clearing component is disposed; and a power unit, wherein:

the clearing component comprises a rotation body and a plurality of clearing elements disposed on the rotation body for clearing a surface of the cleaning roller, the power unit operates to drive the rotation body and each of the plurality of clearing elements to rotate along with the cleaning roller in a same direction, a top surface of the scraper and a base shell, spaced apart from the scraper, define the opening, and the scraper is disposed between the cleaning roller and a trash bin.

2. The cleaning mechanism of claim 1, wherein:

each of the plurality of clearing elements is strip-shaped, a first end of each of the plurality of clearing elements is fixed on the rotation body, and a second end of each of the plurality of clearing elements is spaced apart from the first end by a distance such that, during at least a portion of a rotation of the rotation body, the second end of each of the plurality of clearing elements contacts the cleaning roller.

3. The cleaning mechanism of claim 2, wherein:

a groove is defined between each two adjacent clearing elements of the plurality of clearing elements, and each of the plurality of clearing elements is arranged in one or more groups each extending in a direction substantially parallel to a center line of rotation of the rotation body.

4. The cleaning mechanism of claim 3, wherein:

each group of the one or more groups comprises:

a first clearing element disposed at a first end of the rotation body;

a second clearing element disposed at a second end of the rotation body; and a third clearing element disposed between the first clearing element and the second clearing element, and the third clearing element is spaced apart from a line intersecting the first clearing element and the second clearing element by an offset distance.

5. The cleaning mechanism of claim 1, wherein each of the plurality of clearing elements contacts an outer surface of the cleaning roller during at least a portion of a rotation of the rotation body.

6. The cleaning mechanism of claim 1, wherein the trash bin is disposed between the clearing component and the ground.

7. A floor cleaner, comprising:

a cleaning roller for cleaning ground;

a clearing component operating to clear the cleaning roller;

a scraper having an arc-shaped surface facing the cleaning roller, wherein the scraper defines an opening in which the clearing component is disposed; and a power unit, wherein:

the clearing component comprises a rotation body and a plurality of clearing elements disposed on the rotation body for clearing a surface of the cleaning roller, the power unit operates to drive the rotation body and each of the plurality of clearing elements to rotate along with the cleaning roller in a same direction, a top surface of the scraper and a base shell, spaced apart from the scraper, define the opening, and the scraper is disposed between the cleaning roller and a trash bin.

8. The floor cleaner of claim 7, wherein:

each of the plurality of clearing elements is strip shaped, a first end of each of the plurality of clearing elements is fixed on the rotation body, and a second end of each of the plurality of clearing elements is spaced apart from the first end by a distance such that, during at least a portion of a rotation of the rotation body and each of the plurality of clearing elements, the second end of each of the plurality of clearing elements contacts the cleaning roller.

9. The floor cleaner of claim 8, wherein:

a groove is defined between each two adjacent clearing elements of the plurality of clearing elements, and each of the plurality of clearing elements is arranged in one or more groups each extending in a direction substantially parallel to a center line of rotation of the rotation body.

10. The floor cleaner of claim 9, wherein:

each group of the one or more groups comprises:

a first clearing element disposed at a first end of the rotation body;

a second clearing element disposed at a second end of the rotation body; and a third clearing element disposed between the first clearing element and the second clearing element, and the third clearing element is spaced apart from a line intersecting the first clearing element and the second clearing element by an offset distance.

11. The floor cleaner of claim 7, wherein each of the plurality of clearing elements contacts an outer surface of the cleaning roller during at least a portion of a rotation of the rotation body.

12. The floor cleaner of claim 7, comprising:

a water channel assembly comprising:

a seal element; and a water-squeezing member, wherein:

the seal element and the water-squeezing member are disposed on opposite sides of a water channel and are pressed on a surface of the cleaning roller to form a seal fitting, and a filtering piece is disposed in a gap between the seal element and the water-squeezing member.

13. The floor cleaner of claim 12, wherein:

the base shell comprises a concave portion forming the water channel, the water channel is disposed on a surface of the cleaning roller in a seal and overturn mode, and the filtering piece is laid in the water channel and faces the surface of the cleaning roller.

14. The floor cleaner of claim 7, comprising:

a wastewater tank, wherein:

the wastewater tank comprises a chamber for recovery and storage of wastewater, the chamber is provided with a wastewater inlet, an air extraction opening, and one or more splash-proof members, the one or more splash-proof members are configured to divide the wastewater tank into an accommodation chamber, the one or more splash-proof members are configured to separate the accommodation chamber from the air extraction opening, the one or more splash-proof members are provided with an air vent in communication with the accommodation chamber and the air extraction opening, and the air vent and the air extraction opening have an offset arrangement.

15. The floor cleaner of claim 14, comprising:

a water channel that is configured to cover the cleaning roller with an airtight seal, wherein the wastewater inlet and the water channel are in communication.

16. The floor cleaner of claim 15, comprising:

a clean water tank that is configured to store clean water;

a clean water supply system, wherein:

the clean water tank, the clean water supply system and the water channel are in communication with each other, and the clean water supply system is configured to allow the clean water in the clean water tank to flow to the water channel; and an air pump, wherein an inlet of the air pump and the air extraction opening of the wastewater tank are in communication.

17. The floor cleaner of claim 14, comprising:

a water channel disposed over the cleaning roller;

a clean water tank that is configured to store clean water;

a clean water supply system, wherein:

the clean water tank, the clean water supply system and the water channel are in communication with each other, and the clean water supply system is configured to allow the clean water in the clean water tank to flow to the water channel; and an air pump, wherein an inlet of the air pump and the air extraction opening of the wastewater tank are in communication.

18. The floor cleaner of claim 7, comprising:

a wastewater tank, wherein:

the wastewater tank comprises a chamber for recovery and storage of wastewater, the chamber is provided with a wastewater inlet, an air extraction opening, and one or more splash-proof members, the one or more splash-proof members comprise a first buffer chamber, the first buffer chamber is provided with a first air vent and a second air vent on an upper and a lower end respectively, the one or more splash-proof members are configured to divide the wastewater tank into a second buffer chamber and an accommodation chamber, the accommodation chamber and the first buffer chamber are in communication through the second air vent, the second buffer chamber and the first buffer chamber are in communication through the first air vent, the air extraction opening and the second buffer chamber are in communication, and at least two among the air extraction opening, the first air vent, and the second air vent have an offset arrangement.

19. The floor cleaner of claim 18, comprising:

a water channel that is configured to cover the cleaning roller with an airtight seal, wherein the wastewater inlet and the water channel are in communication;

a clean water tank that is configured to store clean water;

a clean water supply system, wherein:

the clean water tank, the clean water supply system and the water channel are in communication with each other, and the clean water supply system is configured to allow the clean water in the clean water tank to flow to the water channel; and an air pump, wherein an inlet of the air pump and the air extraction opening of the wastewater tank are in communication.

* * * * *